US005248280A

United States Patent [19]

Lockwood et al.

[11] Patent Number: 5,248,280

[45] Date of Patent: Sep. 28, 1993

[54] PHYSICIAN'S PRESCRIPTION PAD AND COVER INSERT

[76] Inventors: Fred L. Lockwood, 107 Sherwood St., #2, Greenville, S.C. 29601; Russell R. Batson, 29 Stono Dr., Greenville, S.C. 29609

[21] Appl. No.: 968,835

[22] Filed: Oct. 30, 1992

[51] Int. Cl.[5] ..... B42D 17/00

[52] U.S. Cl. ..... 462/019; 281/044

[58] Field of Search ..... 462/19, 18, 53, 54, 462/55, 58, 72; 281/44

[56] References Cited

U.S. PATENT DOCUMENTS

| | | | |
|---|---|---|---|
| 635,796 | 10/1899 | Moore | 462/19 |
| 1,636,548 | 7/1927 | Battle | 462/19 |
| 1,747,659 | 2/1930 | Bottle | 462/19 |
| 5,135,437 | 8/1992 | Schubent | 462/19 X |

FOREIGN PATENT DOCUMENTS

| | | | |
|---|---|---|---|
| 210 | 6/1900 | United Kingdom | 462/19 |

*Primary Examiner*—Mark Rosenbaum
*Assistant Examiner*—Willmon Fridie, Jr.
*Attorney, Agent, or Firm*—Ralph Bailey

[57] ABSTRACT

A physician's prescription pad has a number of stacked sets of imperforate prescription forms A secured together by an adhesive binding B at one end of each of the stacked sets of forms. A base member C carries a cover member D presenting advertising material E to the physician as he is in the process of writing a prescription. The cover member serves to protect the stacked sets of forms so as to avoid the transfer of written material to the next set of forms and to present advertising to the physician at the point of use. The prescriptions are separable at the top and are imperforate suitable for presentation to the pharmacist with copies being provided.

3 Claims, 3 Drawing Sheets

Fig. 1.
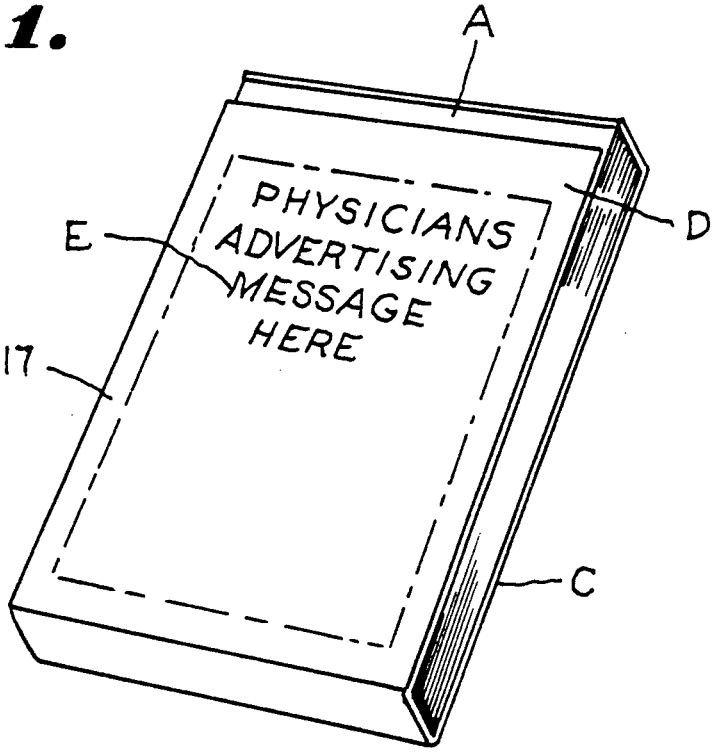
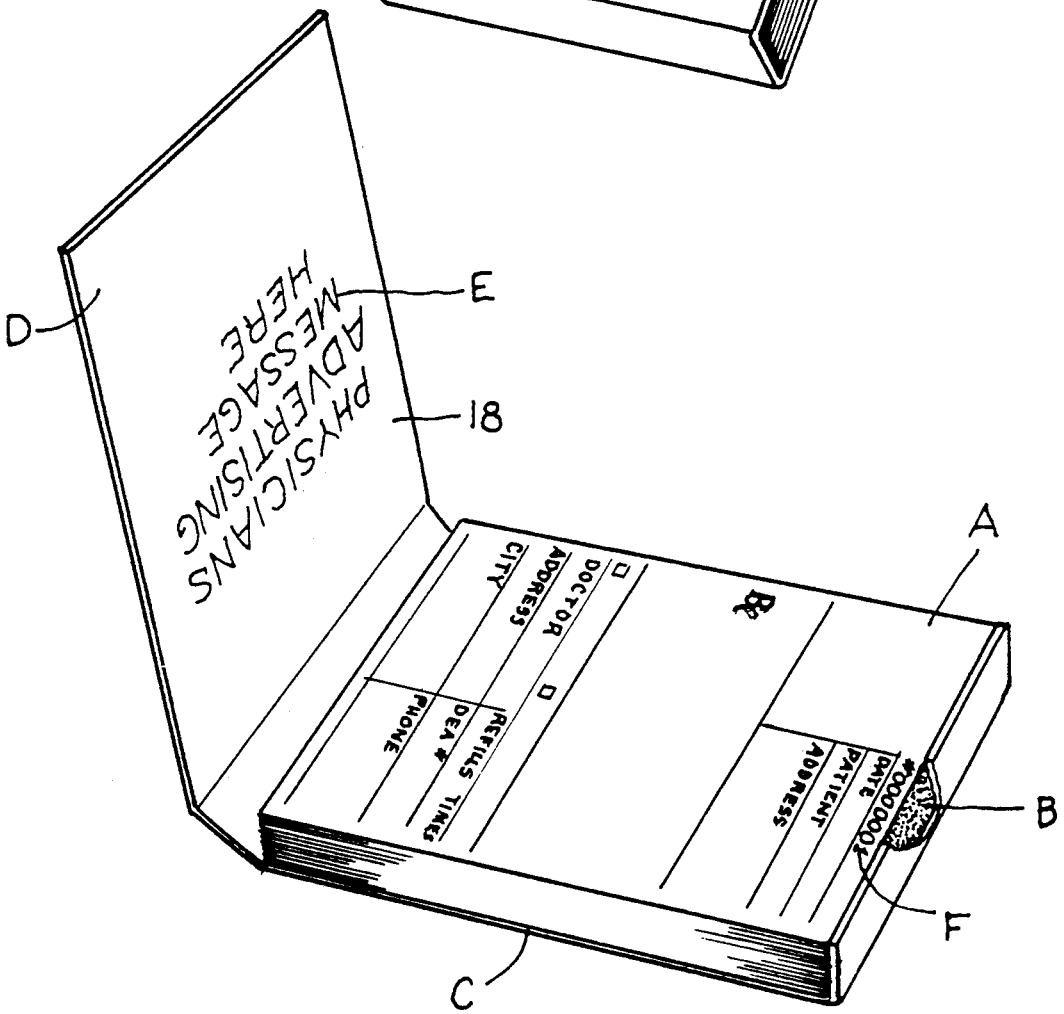
Fig. 2.

PHYSICIAN'S PRESCRIPTION PAD AND COVER INSERT

BACKGROUND OF THE INVENTION

This invention relates to a prescription pad suitable for use by a physician which is provided with a cover which serves also as an insert to avoid transmission of written material from a prescription to a next prescription form stacked therebelow and to present medical information including advertising material at the point of use by the physician.

Bookkeeping pads, check books, and the like have long used stacked carbonless forms usually connected in sheets perforated for separability and provided with an insert to avoid transmission of written material to underlying checks and the like. The sheets of checks are provided in stacked sets for producing appropriate copies, and the sets are connected as by spiral binding for carrying permanent stubs which have been separated at the perforations from the remainder of the sets. Pads and check books having such constructions are illustrated in U.S. Pat. No. 2,840,393.

A truck driver's record keeping system is provided and illustrated in U.S. Pat. No. 4,850,614 wherein a number of perforated trucking forms are stacked upon one another for separation at perforations, and a cover is provided for retaining a stub with an insert being provided for insertion at a lower free end of the stack of material to prevent unwanted passage of written material to carbonless material located therebelow.

Physicians have long used traditional gummed blocks of stacked sets of prescription forms which must be separated at the upper gummed end. No protective cover and no insert have been provided for separating carbonless sets of forms for providing copies as well as an original.

SUMMARY OF THE INVENTION

Accordingly, it is an important object of this invention to provide a physician's pad having a cover which serves several functions including a conveyor of advertising material which is presented to the physician at the point of maximum impact as when writing prescriptions and as an insert to prevent the undesirable transfer of prescription material filled in by the physician to a set of forms lying therebelow.

Another important object of the invention is the provision of a physician's prescription pad having a cover insert which is connected to a base carrying member for the prescription pad adjacent a free end of the prescription pad to act as an insert avoiding transfer of written material while at the same time permitting removal of the imperforate prescription forms from an opposite end of the pad where a separable connection is had as by a suitable gummed adhesive binding the stacked sets and connecting them to a base member.

Another important object of the invention is the provision of a prescription pad which serves to carry stacked sets of prescription forms affording copies through the use of carbonless paper and an insert connected to an end adjacent the free end of the prescription forms for insertion therebetween and at the same time providing a source of advertising material at the point of impact.

It is important to note that the cover sheet overlies the stack of carbonless prescription forms to serve as a protective cover and as an insert to prevent undesirable transfer of written material while serving as a conveyor of advertising material so that the stacked prescription forms may be readily separated entirely from the remainder of the stack by separating the binding at the top by the physician after writing the prescription.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view looking from a lower corner of a physician's prescription pad toward the cover with an advertising message which is in place in overlying relation to a stack of prescription forms constructed in accordance with the present invention;

FIG. 2 is a perspective view illustrating the placement of an additional advertising message of interest to the physician imposed upon a surface of the cover member with the cover raised preparatory to insertion between the uppermost of a stack of prescription forms and a next lower set of prescription forms;

DESCRIPTION OF A PREFERRED EMBODIMENT

A physician's prescription pad has a plurality of stacked sets of superimposed imperforate carbonless prescription forms A. An adhesive binding B at one end of each of the stacked sets of forms secures the forms together for ready manual separation by the physician after writing the prescription. A base member C upon which the stacked sets of forms are fixed has upturned extensions of the base member at each end thereof extending over respective ends of the stacked sets of forms. The one end of stacked set of forms is fastened as by the binding B to an adjacent upturned extension so as to be separable therefrom for removal of a set of forms by the physician upon writing a prescription thereon. A cover member D extends from the other upturned extension adjacent a free end of the stacked set of forms. The cover member overlies an upper side of the stacked set of forms opposite said base and is insertable by the physician between sets of forms when writing prescriptions. Advertising material E of interest to the physician is imposed upon a surface of the cover member. Thus, the cover member has a free end opposite the free end of the stacked sets of forms so as to serve as an upper overlying protective member, so as to be insertable between sets of forms to avoid transfer of material written by the physician upon a next set of forms, and to present the advertising material for observation by the physician when writing a prescription. The prescription forms include indicia F constituting a like number serially imposed upon each form of each set of forms.

The plurality of stacked sets of superimposed imperforate carbonless prescription forms A, in addition to the original prescription form 10, is illustrated as including copies 11 and 12, and desired additional copies may be provided in each of the stacked sets.

Figure 3:
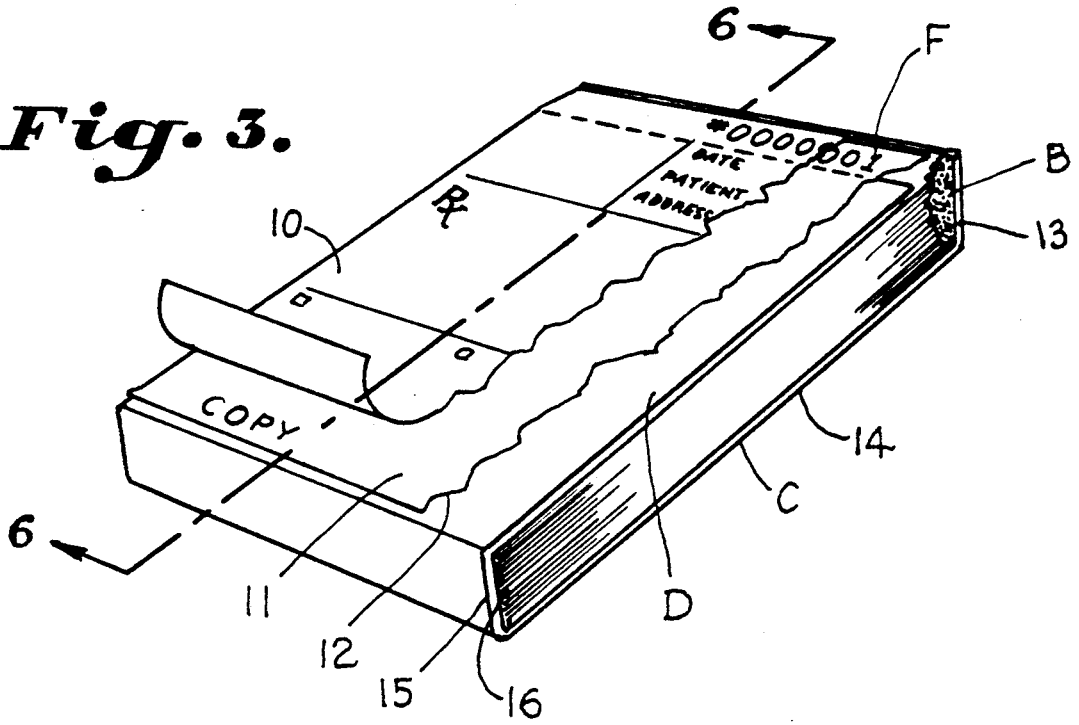
FIG. 3 is a perspective view illustrating the cover member best utilized as an insert extending between a first or uppermost set of prescription forms and a remaining stack of forms and therebelow.

An adhesive binding B is best illustrated in FIGS. 2 and 3 as being of the type utilizing a gummed adhesive which is readily separable so that the physician may separate each of the prescription forms from the top at the location of the adhesive binding and from each other without damaging the prescription forms including copies. The adhesive binding B secures the stack of prescription forms as by adhesive binding B to an upturned extension 13 of a base member C which is integrally connected to provide a bottom 14 having an upturned extension 15 carried at an opposite end upon which the cover member D has integral fixed connection.

Figure 4:
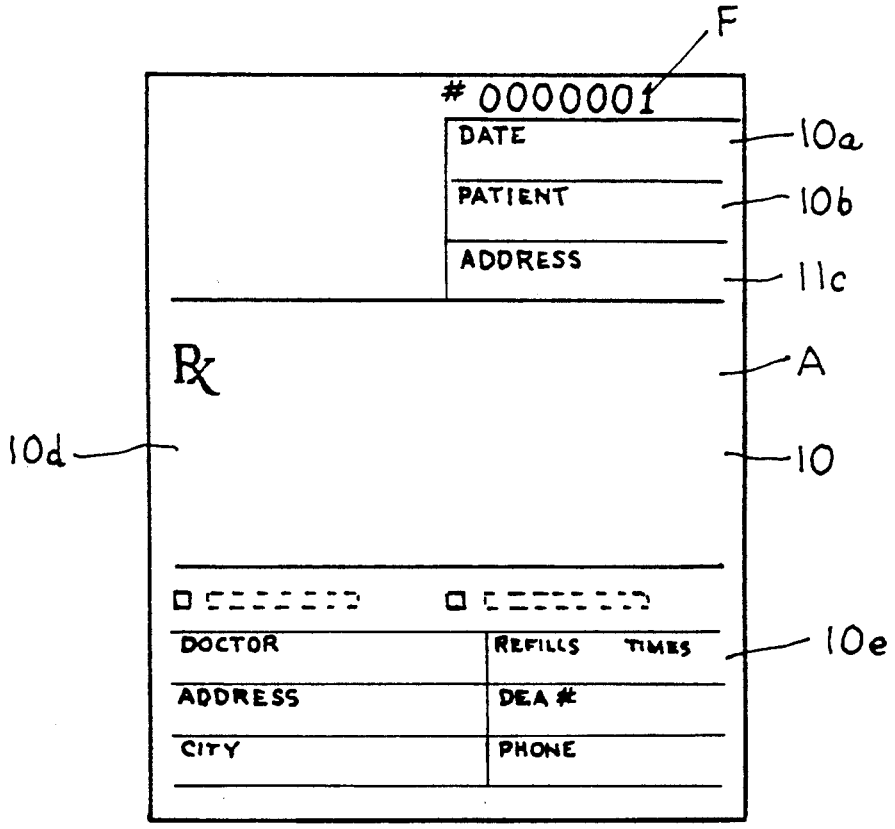
FIG. 4 is a plan view illustrating an uppermost of a stack of imperforate prescription forms having a number serially imposed upon each form of each set of forms.
Figure 5:
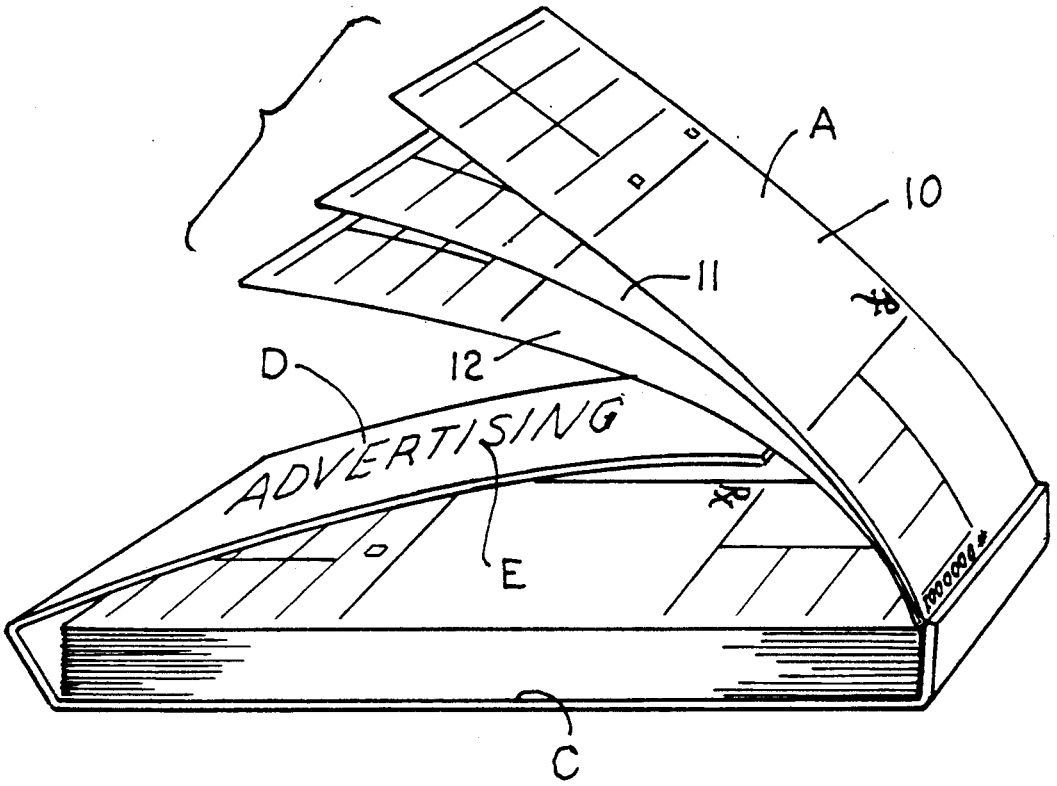
FIG. 5 is a perspective view illustrating a set of prescription forms with a cover insert member being inserted below an uppermost set of forms preparatory to preparing a prescription.
Figure 6:
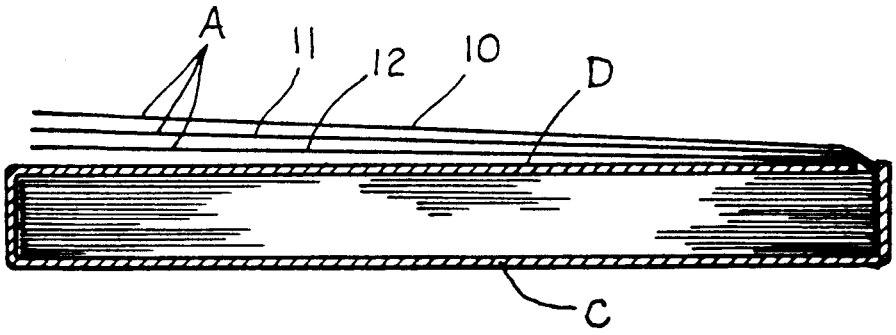
FIG. 6 is a transverse sectional elevation taken on the line 6—6 in FIG. 3.

A free end of the stacked prescription forms is designated at 16 and is shown as having received the cover insert member D in FIG. 3 so as to carry copies 11 and 12 beneath the original imperforate prescription form 10 as in FIG. 3. The prescription form is best illustrated in FIG. 4 wherein the original 10 is illustrated as providing a space 10*a* for the date, a space 10*b* for the patient's name; and a space 10*c* for the address.

The prescription is prefaced as usual with the designation $R_x$ and a space 10*d* provided for receiving the written material as a prescription by the physician. Additional spaces are provided therebelow as desired for designating the name and address of the physician with orders or instructions for refilling or other information desired by the patient, pharmacist and physician and is carried in the lower portion at each of the prescription forms as at 10*e*. It will be observed that the cover member D is slightly shorter than the imperforate prescription forms so that the forms when stacked in superimposed relation may lie flat with the cover member with the uppermost sheet of forms in the remaining stack serving as a cover and at all times as a conveyor of advertising material at the point of greatest impact.

The advertising material E is placed on an outer surface of the cover member D as best illustrated in FIGS. 1 and 2 and is in the form of material which is meaningful to the physician such as the name and quality of a particular drug or device used in the treatment of patients. The advertising material E may be provided in the form of printed indicia or may be otherwise imposed upon an outer surface of the cover member. The outer surface of the cover member in FIG. 1 is illustrated as including an upper side 17 of the cover D thereof. FIG. 2 illustrates an outer surface of the cover member as the lower surface 18 of the cover member where additional advertising material may be utilized. It is important to note that these outer surfaces and especially the upper surface 17 are the last observable features presented to the physician during the process of writing prescriptions.

The number of the prescription form is imposed in such a way that each set of the stacked sets of forms including the original and copies bear the same identifying number. Each of the stacked sets of forms carry an identifying number which is preferably serially imposed thereon. For example, the number of the uppermost of the forms in FIGS. 3 and 4, original and copies, ends with a one, whereas the next lower set of forms have forms with numbers ending with the number 2 (not shown).

It is thus seen that by providing several copies an original prescription may go to the patient, while the physician retains a copy for his file saving time which would be required for transcribing information into the record. A second copy may be provided to maintain other records which may be kept for statistical purposes. The physician's prescription pad thus provided serves utilitarian purposes by providing separable sets of imperforate prescription forms while protecting the forms while providing advertising material to the physician as well as guarding against undesirable transfer of prescriptions to the lower sheets of the prescription pad. The prescription pads hereof are of simple versatile construction which may be economically manufactured.

While a preferred embodiment of the invention has been described using specific terms, such description is for illustrative purposes only, and it is to be understood that changes and variations may be made without departing from the spirit or scope of the following claims.

What is claimed is:

1. A physician's prescription pad comprising:

a plurality of stacked sets of superimposed imperforate carbonless prescription forms;

an adhesive binding at one end of each of said stacked sets of forms securing said forms together for ready manual separation by the physician after writing the prescription;

a base member upon which the stacked sets of forms are fixed;

a first upturned extension of said base member extending over one end of said stacked sets of forms;

a second upturned extension of said base member extending over an end opposite said one end of said stacked sets of forms;

said stacked set of forms being fastened to said base member so as to be separable from said base member and from each other for removal of a set of forms by the physician upon writing a prescription thereon;

a cover member extending from said second upturned extension adjacent a free end of said stacked set of forms, said cover member having a length shorter in respect to a length of said prescription forms when in overlying relation;

said cover member overlying an upper side of said stacked set of forms opposite said base and being insertable by the physician between sets of forms when writing prescriptions; and advertising material of interest to the physician imposed upon a surface of said cover member;

whereby said cover member has a free end opposite said one end of said stacked sets of forms so as to serve as an upper overlying protective member, so as to be insertable between sets of forms to avoid transfer of material written by the physician upon a next set of forms, and to present said advertising material for observation by the physician when writing a prescription.

2. The structure set forth in claim 1 including indicia constituting a like number serially imposed upon each form of each set of forms.

3. The structure set forth in claim 1 wherein said first upturned extension of said base member includes means fastening said base to said one end of said stacked sets of forms by said adhesive binding.

* * * * *